US005894258A

United States Patent [19]

Chang

[11] Patent Number: 5,894,258

[45] Date of Patent: Apr. 13, 1999

[54] STRUCTURE OF COMBINATION TYPE FUSIBLE PLUGS

[76] Inventor: Yen Chun Chang, No. 8, Lane 247, Neu Pu Road, Hsinchu City, Taiwan

[21] Appl. No.: 09/033,961

[22] Filed: Mar. 3, 1998

[51] Int. Cl.[6] ..... H01R 13/68

[52] U.S. Cl. ..... 337/255; 337/198; 439/621; 439/622

[58] Field of Search ..... 337/255, 197, 337/198, 260–264; 439/621, 622

[56] References Cited

U.S. PATENT DOCUMENTS

| | | | |
|---|---|---|---|
| 2,668,885 | 2/1954 | Gerlat | 337/198 |
| 4,080,039 | 3/1978 | Ahroni | 339/147 R |
| 4,178,061 | 12/1979 | Ahroni | 339/147 P |
| 4,684,914 | 8/1987 | Wu | 337/198 |
| 4,904,976 | 2/1990 | Liaq | 337/197 |
| 5,281,943 | 1/1994 | Liao | 337/198 |
| 5,320,563 | 6/1994 | Liao | 439/622 |
| 5,451,173 | 9/1995 | Mai | 439/622 |
| 5,791,941 | 8/1998 | Wang | 439/622 |

*Primary Examiner*—Leo P. Picard
*Assistant Examiner*—Anatoly Vortman
*Attorney, Agent, or Firm*—Rosenberg, Klein & Bilker

[57] ABSTRACT

The invention disclosed an improved structure for combination type fusible plugs, comprising a shell and two individual plug seats that can respectively combine with conductor copper blades, fuses, and electrical wires and then be housed inside the shell to form a complete fusible plug. With an effective separation of electrical wires, conductor copper blades, and fuses from each other, the plug structure of the invention can provide more safety in use.

2 Claims, 4 Drawing Sheets

STRUCTURE OF COMBINATION TYPE FUSIBLE PLUGS

BACKGROUND OF THE INVENTION

A fusible plug can provide safety in use. When current exceeds a specified value, the fuse will melt away so that current will be interrupted, preventing the occurrence of accidents. A prior fusible plug typically contains a shell, a plug seat, and a plurality of partitions in the shell for accommodating conductor copper blades, fuses, and conductor wires and terminals. Such structures are known in U.S. Pat. No. 5,281,943 and 5,482,478. Because that the interior of those prior fusible plug structures is still communicable, it is possible to have shorting between those conductor components when moisture infiltration, resulting in injury to human or damage to properties. Hence, a prior fusible plug has the concerns with safety.

In view of the above problem, the primary object of the invention is to provide an improved structure of combination type fusible plugs that comprises two independent plug seats each having a set of electrical wires, fuses, and conductor copper blades and jointly seated inside a shell. Thus the structure according to the invention can effectively eliminate the shortcoming of prior plugs. Now the structure and features of a fusible plug of the invention will be described in more detail with reference to accompanying drawings.

BRIEF DESCRIPTION OF ACCOMPANYING DRAWINGS

DETAILED DESCRIPTION OF PREFERRED EMBODIMENTS

Figure 1:
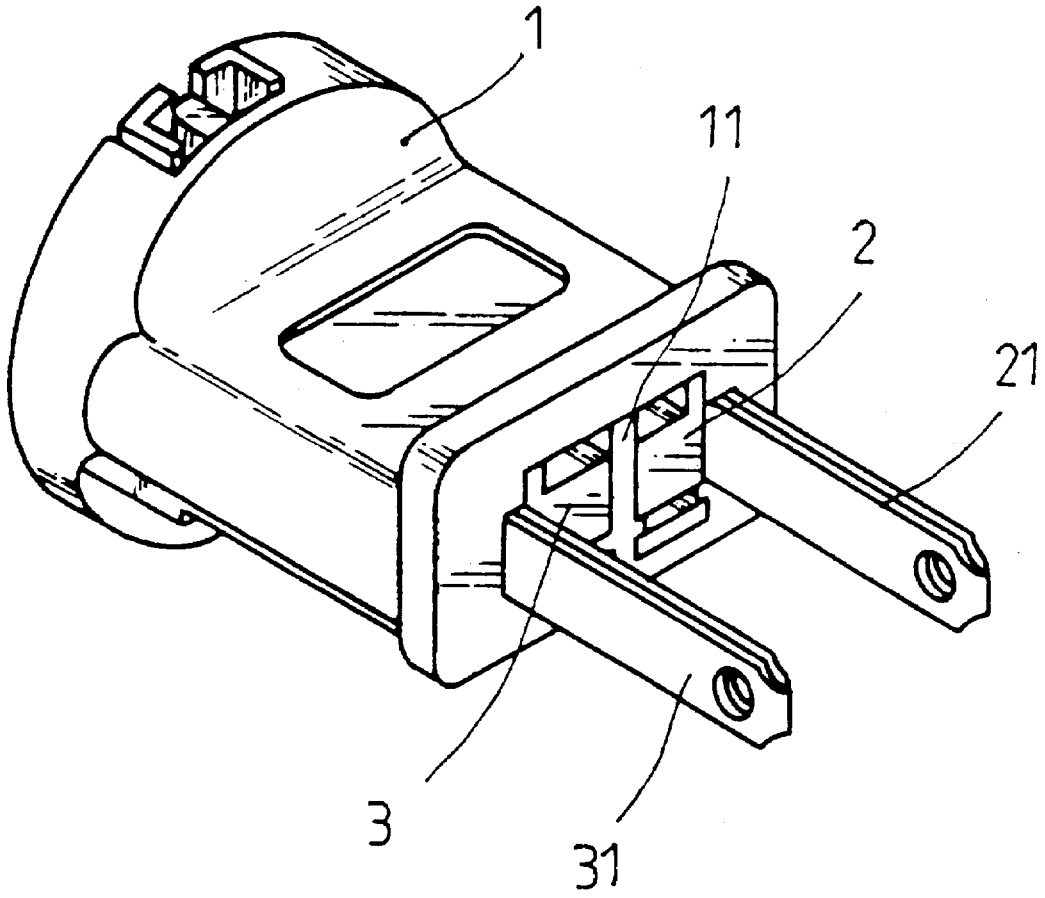
FIG. 1 is a perspective view depicting the outer appearance of a fusible plug according to the invention.
Figure 2:
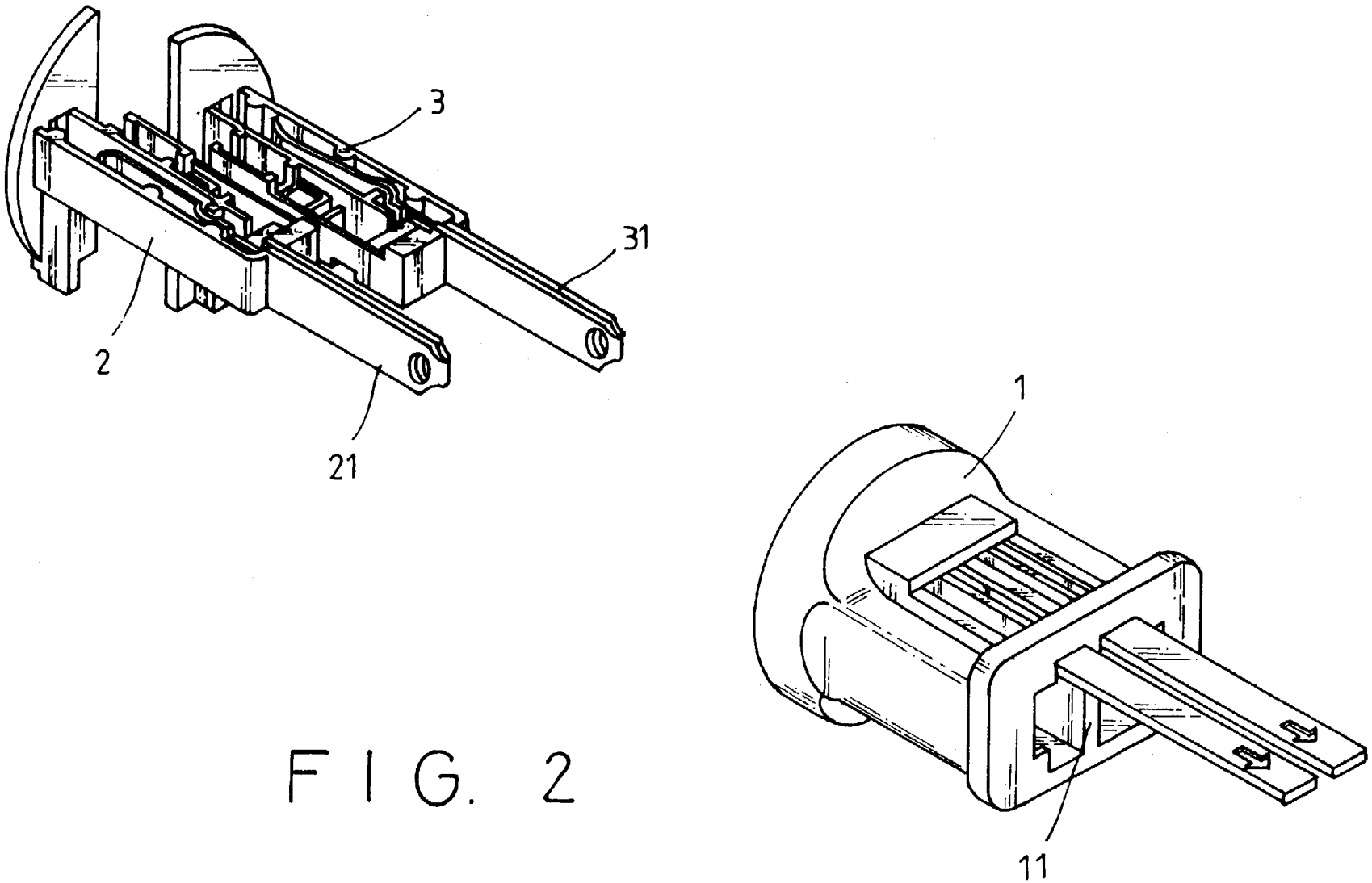
FIG. 2 is an exploded view of the fusible plug of FIG. 1.

As shown in FIGS. 1 and 2, the plug of the invention mainly includes a shell (1), and two symmetrical plug seats (2, 3). The interiors of the plug seats (2, 3) are provided with partitions to for compartments for receiving conductor copper blades (21, 31) and fuses and electrical wires. The placement of those components is known to the public and so it will not be detailed here. The two sets of plug seats can be jointly incorporated into the shell (1), with a central partition (11) separating them from each other.

With such a configuration, the conductor copper blades, fuses and electrical wires in one plug seat are double protected from contact with parts in the other plug seat. Thus electrical shorting or leakage would never happen even if moisture infiltrates into the plug or there exists water vapor in the plug.

Figure 3:
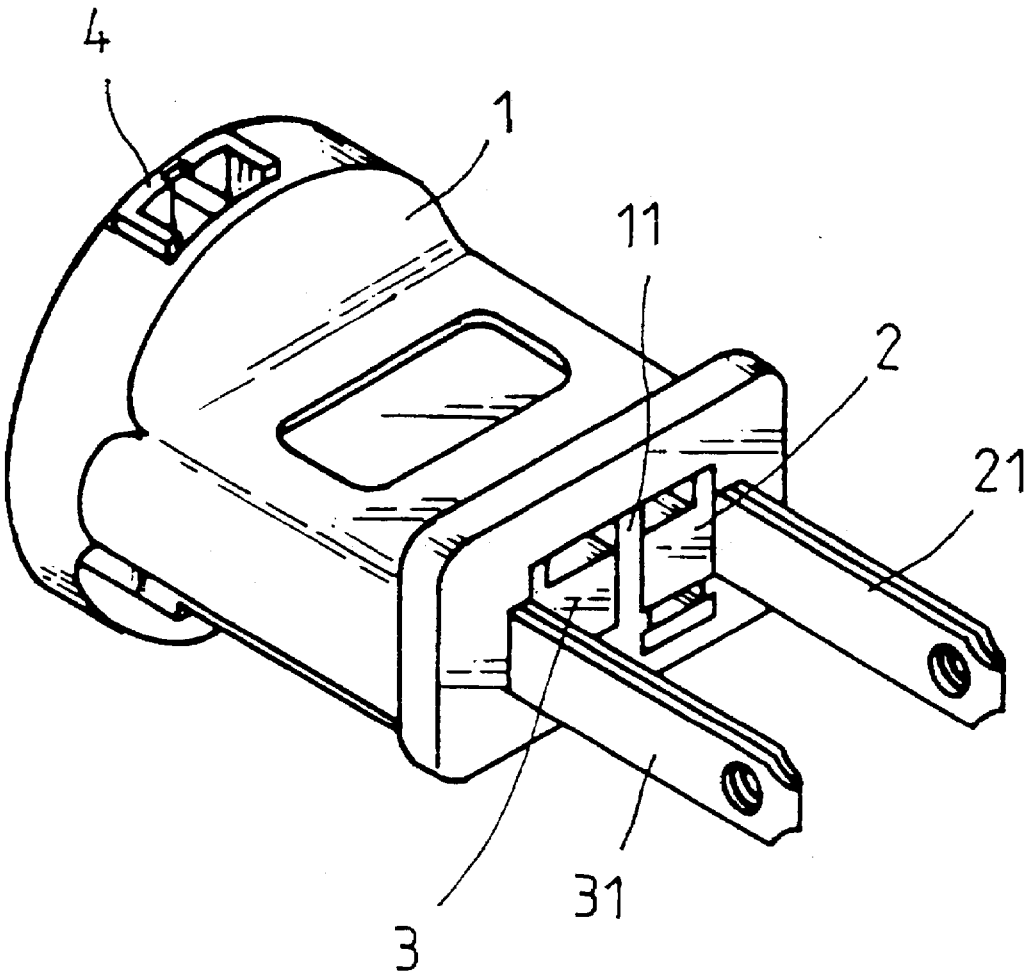
FIG. 3 shows another embodiment of a fusible plug according to the invention.
Figure 4:
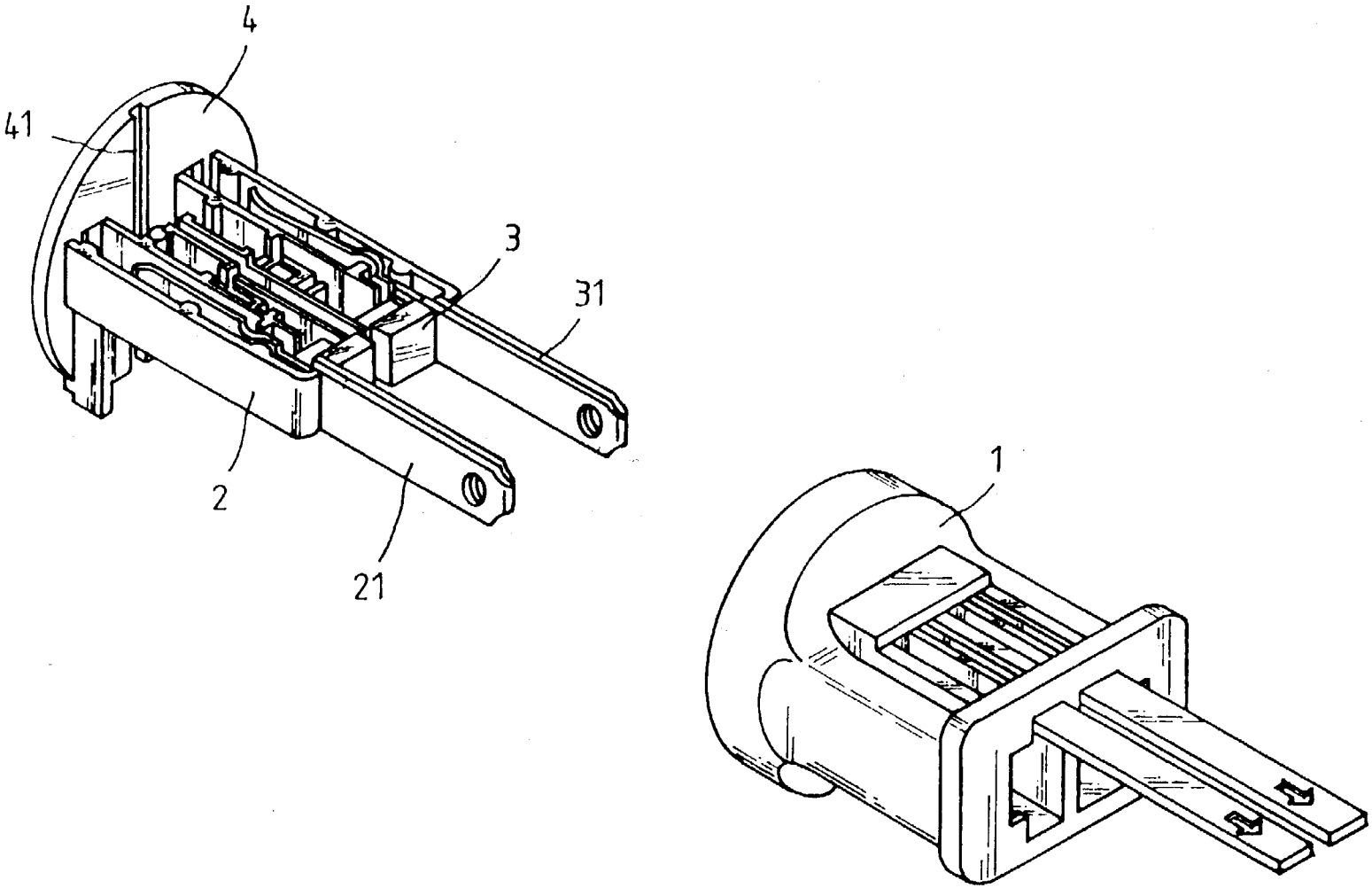
FIG. 4 is an exploded view of the plug of FIG. 3.

As shown in FIGS. 3 and 4, another embodiment of plug structure of the invention similarly contains a shell (1) and two symmetrical plug seats (2, 3). The plug seat is featured by a disk-like back plate (4) situated behind two plug seats. The back plate (4) is provided with a long slot (41) aiming at the gap between two plug seats (2, 3). When the back plate along with fuses and copper blades is put into the shell (1), a partition integrated with the shell will extend between two sets of plug seats and engage at the end thereof with the long slot (41). Therefore, the plug structure can also obtain the best protection, preventing electrical leakage and shorting as well as providing convenience in assembling. As a result, the plug structure according to the invention can eliminate the defects of a prior electrical plug and enhance the performance of a fusible plug.

What is claimed is:

1. An improved structure of combination type fusible plugs, comprising a shell with a central partition, two sets of independent symmetrical plug seats respectively receiving conductor copper blades, fuses, and conductor wires, said two sets of plug seats being able to be jointly and slidably inserted into said shell, with the central partition extending therebetween to separate the conductor components and prevent electrical shorting resulting from moisture infiltration.

2. An improved structure of combination type fusible plugs as claimed in claim 1, provided in which is a disk-like back plate of plug seats that contains a long slot at the central area, said long slot being disposed to aim at the gap between two sets of plug seats so that when the back plate along with plug seats is inserted into the shell the central partition of the shell will extend between two plug seats with the end of the partition engaged with said long slot, resulting in an effective protection of moisture infiltration.

* * * * *